US007262564B2

(12) United States Patent
Krichtafovitch et al.

(10) Patent No.: US 7,262,564 B2
(45) **Date of Patent: *Aug. 28, 2007**

(54) ELECTROSTATIC FLUID ACCELERATOR FOR AND A METHOD OF CONTROLLING FLUID FLOW

(75) Inventors: Igor A. Krichtafovitch, Redmond, WA (US); Vladimir L. Gorobets, Redmond, WA (US)

(73) Assignee: Kronos Advanced Technologies, Inc., Belmont, MA (US)

( * ) Notice: Subject to any disclaimer, the term of this patent is extended or adjusted under 35 U.S.C. 154(b) by 315 days.

This patent is subject to a terminal disclaimer.

(21) Appl. No.: 10/806,473

(22) Filed: Mar. 23, 2004

(65) Prior Publication Data

US 2004/0217720 A1 Nov. 4, 2004

Related U.S. Application Data

(63) Continuation of application No. 10/188,069, filed on Jul. 3, 2002, now Pat. No. 6,727,657.

(51) Int. Cl.
*H05H 7/00* (2006.01)

(52) U.S. Cl. ..... 315/500; 315/506; 315/503; 315/5.42; 315/111.61

(58) Field of Classification Search ..... 315/500, 315/506; 55/138, 151, 136–137
See application file for complete search history.

(56) References Cited

U.S. PATENT DOCUMENTS

| | | | |
|---|---|---|---|
| 1,934,923 | A | 11/1933 | Heinrich |
| 1,959,374 | A | 5/1934 | Lissman |
| 2,765,975 | A | 10/1956 | Lindenblad |
| 2,950,387 | A | 8/1960 | Brubaker |
| 3,026,964 | A | 3/1962 | Penney |
| 3,071,705 | A | 1/1963 | Coleman et al. |
| 3,198,726 | A | 8/1965 | Trikilis |
| 3,443,358 | A | 5/1969 | Drenning et al. |
| 3,740,927 | A | 6/1973 | Vincent |

(Continued)

FOREIGN PATENT DOCUMENTS

| | | |
|---|---|---|
| JP | 63-143954 | 6/1988 |

OTHER PUBLICATIONS

Request for Ex Parte Reexamination under 37 C.F.R. 1.510; U.S. Appl. No. 90/007,276, filed on Oct. 29, 2004.

*Primary Examiner*—Tho Phan
*Assistant Examiner*—Chuc Tran
(74) *Attorney, Agent, or Firm*—Fulbright & Jaworski L.L.P.

(57) ABSTRACT

An electrostatic fluid acceleration and method of operation thereof includes at least two synchronously powered stages. A single power supply or synchronized and phase controlled power supplies provide high voltage power to each of the stages such that both the phase and amplitude of the electric power applied to the corresponding electrodes are aligned in time. The frequency and phase control allows neighboring stages to be closely spaced at a distance of from 1 to 2 times an inter-electrode distance within a stage, and, in any case, minimizing or avoiding production of a back corona current from a corona discharge electrode of one stage to an electrode of a neighboring stage. Corona discharge electrodes of neighboring stages may be horizontally aligned, complementary collector electrodes of all stages being similarly horizontally aligned between and horizontally offset from the corona discharge electrodes.

27 Claims, 4 Drawing Sheets

U.S. PATENT DOCUMENTS 3,907,520 A 9/1975 Huang et al.
3,918,939 A 11/1975 Hardt
3,981,695 A 9/1976 Fuchs
3,984,215 A 10/1976 Zucker
4,086,152 A 4/1978 Rich et al.
4,216,000 A 8/1980 Kofoid
RE30,480 E 1/1981 Gelfand
4,315,837 A 2/1982 Rourke et al.
4,376,637 A 3/1983 Yang
4,401,385 A 8/1983 Katayama et al.
4,481,017 A 11/1984 Furlong
4,600,411 A 7/1986 Santamaria
4,604,112 A 8/1986 Ciliberti et al.
4,643,745 A * 2/1987 Sakakibara et al. ..... 96/76
4,646,196 A 2/1987 Reale
4,649,703 A 3/1987 Dettling et al.
4,740,862 A 4/1988 Halleck
4,741,746 A 5/1988 Chao et al.
4,772,998 A 9/1988 Guenther, Jr. et al.
4,775,915 A 10/1988 Walgrove, III
4,783,595 A 11/1988 Seidl
4,789,801 A 12/1988 Lee
4,790,861 A 12/1988 Watai et al.
4,808,200 A 2/1989 Dallhammer et al.
4,838,021 A 6/1989 Beattie
4,878,149 A 10/1989 Stiehl et al.
4,936,876 A 6/1990 Reyes
4,938,786 A 7/1990 Tonomoto
5,037,456 A * 8/1991 Yu ..... 96/76
5,059,219 A 10/1991 Plaks et al.
5,087,943 A 2/1992 Creveling
5,136,461 A 8/1992 Zellweger
5,138,513 A 8/1992 Weinstein
5,163,983 A 11/1992 Lee
5,199,257 A 4/1993 Colletta et al.
5,257,073 A 10/1993 Gross et al.
5,269,131 A 12/1993 Brophy
5,369,953 A 12/1994 Brophy
5,423,902 A 6/1995 Strutz et al.
5,508,880 A 4/1996 Beyer
5,542,967 A 8/1996 Ponizovsky et al.
5,642,254 A 6/1997 Benwood et al.
5,707,422 A 1/1998 Jacobsson et al.
5,847,917 A 12/1998 Suzuki
D411,001 S 6/1999 Pinchuk
5,920,474 A 7/1999 Johnson et al.
5,942,026 A 8/1999 Erlichman et al.
D420,438 S 2/2000 Pinchuk
D427,300 S 6/2000 Pinchuk
6,108,504 A 8/2000 Dickhoff
D433,494 S 11/2000 Pinchuk et al.
D434,483 S 11/2000 Pinchuk
D438,513 S 3/2001 Pinchuk
6,195,827 B1 3/2001 Dumitriu
D440,290 S 4/2001 Pinchuk
6,224,653 B1 5/2001 Shvedchikov et al.
6,228,330 B1 5/2001 Herrmann et al.
6,394,086 B1 5/2002 Barnes et al.
6,574,123 B2 6/2003 Wiser et al.
6,888,314 B2 5/2005 Krichtafovitch et al.
6,919,698 B2 7/2005 Krichtafovitch
7,053,565 B2 * 5/2006 Krichtafovitch et al. .... 315/506
2002/0122751 A1 9/2002 Sinaiko et al.
2002/0122752 A1 9/2002 Taylor et al.
2002/0127156 A1 9/2002 Taylor
2002/0155041 A1 10/2002 McKinney, Jr. et al.
2003/0033176 A1 2/2003 Hancock
2003/0147785 A1 8/2003 Joannou
2003/0165410 A1 9/2003 Taylor
2003/0170150 A1 9/2003 Lau et al.
2003/0206837 A1 11/2003 Taylor et al.
2003/0206839 A1 11/2003 Taylor et al.
2003/0206840 A1 11/2003 Taylor et al.
2003/0209420 A1 11/2003 Taylor et al.
2004/0025497 A1 2/2004 Truce
2004/0033340 A1 2/2004 Lau et al.
2004/0047775 A1 3/2004 Lau et al.
2004/0052700 A1 3/2004 Kotlyar et al.
2004/0057882 A1 3/2004 Lau et al.
2004/0079233 A1 4/2004 Lau et al.
2004/0212329 A1 10/2004 Krichtafovitch et al.
2004/0217720 A1 11/2004 Krichtafovitch et al.
2005/0151490 A1 7/2005 Krichtafovitch

* cited by examiner

ELECTROSTATIC FLUID ACCELERATOR FOR AND A METHOD OF CONTROLLING FLUID FLOW

RELATED APPLICATIONS

This application is a continuation of U.S. patent application Ser. No. 10/188,069 filed Jul. 3, 2002 now U.S. Pat. No. 6,727,657 and entitled Electrostatic Fluid Accelerator For And A Method Of Controlling Fluid Flow and is related to U.S. patent application Ser. No. 09/419,720 filed Oct. 14, 1999 and entitled Electrostatic Fluid Accelerator, now U.S. Pat. No. 6,504,308, U.S. patent application Ser. No. 10/175,947 filed Jun. 21, 2002 and entitled Method of and Apparatus for Electrostatic Fluid Acceleration Control of a Fluid Flow, now U.S. Pat. No. 6,664,741; U.S. patent application Ser. No. 10/187,983 filed Jul. 3, 2002 and entitled Spark Management Method And Device; U.S. patent application Ser. No. 10/188,069 filed Jul. 3, 2002 and entitled Electrostatic Fluid Accelerator For and a Method Of Controlling Fluid Flow; U.S. patent application Ser. No. 10/295,869 filed Nov. 18, 2002 and entitled Electrostatic Fluid Accelerator which is a continuation of U.S. provisional application Ser. No. 60/104,573, filed on Oct. 16, 1998; U.S. patent application Ser. No. 10/724,707 filed Dec. 2, 2003 and entitled Corona Discharge Electrode and Method of Operating Same; U.S. patent application Ser. No. 10/735,302 filed Dec. 15, 2003 and entitled Method of and Apparatus for Electrostatic Fluid Acceleration Control of a Fluid; and U.S. patent application Ser. No. 10/752,530 filed Jan. 8, 2004 and entitled Electrostatic Air Cleaning Device, all of which are incorporated herein in their entireties by reference.

BACKGROUND OF THE INVENTION

1. Field of the Invention

The invention relates to a device for and method of accelerating, and thereby imparting velocity and momentum to a fluid, and particularly to the use of corona discharge technology to generate ions and electrical fields especially through the use of ions and electrical fields for the movement and control of fluids such as air.

2. Description of the Related Art

A number of patents (see, e.g., U.S. Pat. No. 4,210,847 by Shannon, et al. and U.S. Pat. No. 4,231,766 by Spurgin) describe ion generation using an electrode (termed the "corona electrode"), attracting and, therefore, accelerating the ions toward another electrode (termed the "collecting" and/or "attracting" electrode), thereby imparting momentum to the ions in a direction toward the attracting electrode. Collisions between the ions and the fluid, such as surrounding air molecules, transfer the momentum of the ions to the fluid inducing a corresponding movement of the fluid.

U.S. Pat. No. 4,789,801 of Lee, U.S. Pat. No. 5,667,564 of Weinberg, U.S. Pat. No. 6,176,977 of Taylor, et al., and U.S. Pat. No. 4,643,745 of Sakakibara, et al. also describe air movement devices that accelerate air using an electrostatic field. Air velocity achieved in these devices is very low and is not practical for commercial or industrial applications.

U.S. Pat. Nos. 3,699,387 and 3,751,715 of Edwards describe the use of multiple stages of Electrostatic Air Accelerators (EFA) placed in succession to enhance air flow. These devices use a conductive mesh as an attracting (collecting) electrode, the mesh separating neighboring corona electrodes. The mesh presents a significant air resistance and impairs air flow thereby preventing the EFA from attaining desirable higher flow rates.

Unfortunately, none of these devices are able to produce a commercially viable amount of the airflow. Providing multiple stages of conventional air movement devices cannot, in and of itself, provide a solution. For example, five serial stages of electrostatic fluid accelerators placed in succession deliver only a 17% greater airflow than one stage alone. See, for example, U.S. Pat. No. 4,231,766 of Spurgin.

Accordingly, a need exists for a practical electrostatic fluid accelerator capable of producing commercially useful flow rates.

SUMMARY OF THE INVENTION

The invention addresses several deficiencies in the prior art limitations on air flow and general inability to attain theoretical optimal performance. One of these deficiencies includes excessive size requirements for multi-stage EFA devices since several stages of EFA, placed in succession, require substantial length along an air duct (i.e., along air flow direction). This lengthy duct further presents greater resistance to air flow.

Still other problems arise when stages are placed close to each. Reduced spacing between stages may produce a "back corona" between an attractor electrode of one stage and a corona discharge electrode of an adjacent next stage that results in a reversed air flow. Moreover, due to the electrical capacitance between the neighboring stages, there is a parasitic current flow between neighboring stages. This current is caused by non-synchronous high voltage ripples or high voltage pulses between neighboring stages.

Still another problem develops using large or multiple stages so that each separate (or groups of) stage(s) is provided with its own high voltage power supply (HVPS). In this case, the high voltage required to create the corona discharge may lead to an unacceptable level of sparks being generated between the electrodes. When a spark is generated, the HVPS must completely shut down for some period of time required for deionization and spark quenching prior to resuming operation. As the number of electrodes increases, sparks are generated more frequently than with one set of electrodes. If one HVPS feeds several sets of electrodes (i.e., several stages) then it will be necessary to shut down more frequently to extinguish the increased number of sparks generated. That leads to an undesirable increase in power interruption for the system as a whole. To address this problem, it may be beneficial to feed each stage from its own dedicated HVPS. However, using separate. HVPS requires that consecutive stages be more widely spaced to avoid undesirable electrical interactions caused by stray capacitance between the electrodes of neighboring stages and to avoid production of a back corona.

The present invention represents an innovative solution to increase airflow by closely spacing EFA stages while minimizing or avoiding the introduction of undesired effects. The invention implements a combination of electrode geometry, mutual location and the electric voltage applied to the electrodes to provide enhanced performance.

According to an embodiment of the invention, a plurality of corona electrodes and collecting electrodes are positioned parallel to each other or extending between respective planes perpendicular to an airflow direction. All the electrodes of neighboring stages are parallel to each other, with all the electrodes of the same kind (i.e., corona discharge electrodes or collecting electrodes) placed in the same parallel planes that are orthogonal to the planes where electrodes of the same kind or electrodes edges are located. According to another feature, stages are closely spaced to avoid or minimize any corona discharge between the electrodes of neighboring stages. If the closest spacing between adjacent electrodes is "a", the ratio of potential differences (V1–V2) between a voltage V1 applied to the first electrode and a voltage V2 applied to the closest second electrode, and the distance between the electrodes is a normalized distance "aN", then aN=(V1–V2)/a. The normalized distance between the corona discharge wire of one stage to the closest part of the neighboring stage should exceed the corona onset voltage applied between these electrodes, which, in practice, means that it should be no less than 1.2 to 2.0 times of the normalized distance from the corona discharge to the corresponding associated (i.e., nearest) attracting electrode(s) in order to prevent creation of a back corona.

Finally, voltages applied to neighboring stages should be synchronized and syn-phased. That is, a.c. components of the voltages applied to the electrodes of neighboring stages should rise and fall simultaneously and have substantially the same waveform and magnitude and/or amplitude.

The present invention increases EFA electrode density (typically measured in stages-per-unit-length) and eliminates or significantly decreases stray currents between the electrodes. At the same time, the invention eliminates corona discharge between electrodes of neighboring stages (e.g., back corona). This is accomplished, in part, by powering neighboring EFA stages with substantially the same voltage waveform, i.e., the potentials on the neighboring electrodes have the same or very similar alternating components so as to eliminate or reduce any a.c. differential voltage between stages. Operating in such a synchronous manner between stages, electrical potential differences between neighboring electrodes of adjacent EFA components remains constant and any resultant stray current from one electrode to another is minimized or completely avoided. Synchronization may be implemented by different means, but most easily by powering neighboring EFA components with respective synchronous and syn-phased voltages from corresponding power supplies, or with power supplies synchronized to provide similar amplitude a.c. components of the respective applied voltages. This may be achieved with the same power supply connected to neighboring EFA components or with different, preferably matched power supplies that produce synchronous and syn-phased a.c. component of the applied voltage.

DESCRIPTION OF THE PREFERRED EMBODIMENT

Figure 1B:
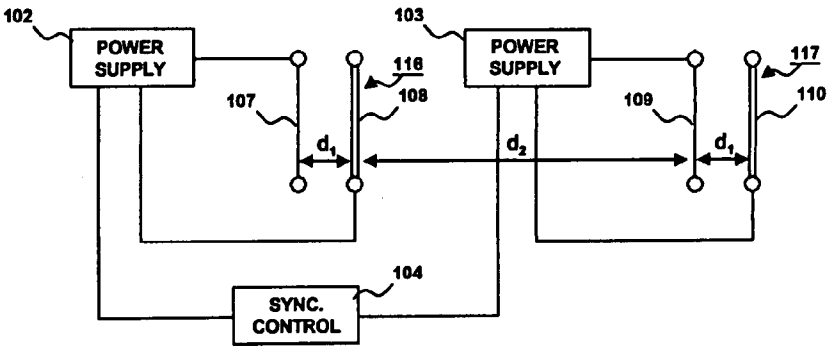
FIG. 1B is a schematic diagram of an EFA assembly with a pair of synchronized power supplies feeding respective adjacent corona discharge stages.
Figure 1A:
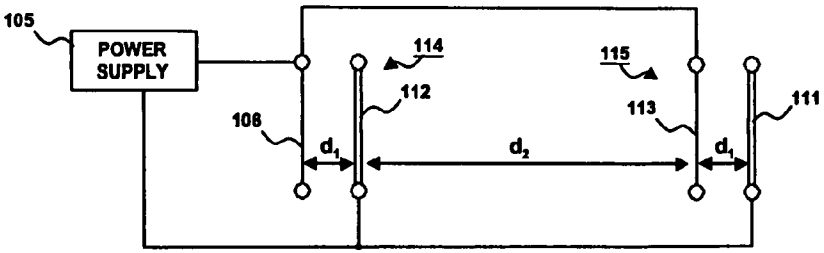
FIG. 1A is a schematic diagram of an Electrostatic Fluid Accelerator (EFA) assembly with a single high voltage power supply feeding adjacent corona discharge stages.

FIG. 1A is a schematic diagram, of an Electrostatic Fluid Accelerator (EFA) device 100 comprising two EFA stages 114 and 115. First EFA stage 114 includes corona discharge electrode 106 and associated accelerating electrode 112; second EFA stage 115 includes corona discharge electrode 113 and associated accelerating electrode 111. Both EFA stages and all the electrodes are shown schematically. Only one set of corona discharge and collecting electrodes are shown per stage for ease of illustration, although it is expected that each stage may include a large number of arrayed pairs of corona and accelerating electrodes. An important feature of EFA 100 is that the distance $d_1$ between the corona discharge electrode 106 and collector electrode 112 is comparable to the distance $d_2$ between collector electrode 112 and the corona discharge electrode 113 of the subsequent stage 115, i.e., the closest distance between elements of adjacent stages is not much greater than the distance between electrodes within the same stage. Typically, the inter-stage distance $d_2$ between collector electrode 112 and corona discharge electrode 113 of the adjacent stage should be between 1.2 and 2.0 times that of the intra-stage spacing distance $d_1$ between corona discharge electrode 106 and collector electrode 112 (or spacing between corona discharge electrode 113, and collector electrode 111) within the same stage. Because of this consistent spacing, capacitance between electrodes 106 and 112 and between 106 and 113 are of the same order. Note that, in this arrangement, the capacitance coupling between corona discharge electrodes 106 and 113 may allow some parasitic current to flow between the electrodes. This parasitic current is of the same order of amplitude as a capacitive current between electrode pair 106 and 112. To decrease unnecessary current between electrodes 113 and 106, each should be supplied with synchronized high voltage waveforms. In the embodiment depicted in FIG. 1A both EFA stages are powered by a common power supply 105 i.e., a power supply having a single voltage conversion circuit or "converter" (e.g., power transformer, rectifier, and filtering circuits, etc.) feeding both stages in parallel. This ensures that the voltage difference between electrodes 106 and 113 is maintained constant relative to electrodes 106 and 111 so that no or only a very small current flows between electrodes 106 and 113.

FIG. 1B shows an alternate configuration of an EFA 101 including a pair of EFA stages 116 and 117 powered by separate converters in the form of power supplies 102 and 103, respectively. First EFA stage 116 includes corona discharge electrode 107 and collecting electrode 108 forming a pair of complementary electrodes within stage 116. Second EFA stage 117 includes corona discharge electrode 109 and collecting electrode 110 forming a second pair of complementary electrodes. Both EFA stage 116, 117 and all electrodes 107-110 are shown schematically.

First EFA stage 116 is powered by power supply 102 and second EFA stage 117 is powered by power supply 103. Both EFA stages as well as both power supplies 102 and 103 may be of the same design to simplify synchronization, although different designs may be used as appropriate to accommodate alternative arrangements. Power supplies 102 and 103 are synchronized by the control circuitry 104 to provide synchronized power outputs. Control circuitry ensures that both power supplies 102 and 103 generate synchronized and syn-phased output voltages that are substantially equal such that the potential difference between the electrodes 107 and 109 is maintained substantially constant (e.g., has no or very small a.c. voltage component). (Note: While the term "synchronized" generally includes both frequency and phase coincidence between signals, the phase-alignment requirement is further emphasized by use of the term "syn-phase" requiring that the signals be in-phase with each other at the relevant locations, e.g., as applied to and as present at each stage.) Maintaining this potential difference constant (i.e., minimizing or eliminating any a.c. voltage component) limits or eliminates any capacitive current flow between electrodes 107 and 109 to an acceptable value, e.g., typically less than 1 mA and preferably less than 100 μA.

Figure 2B:
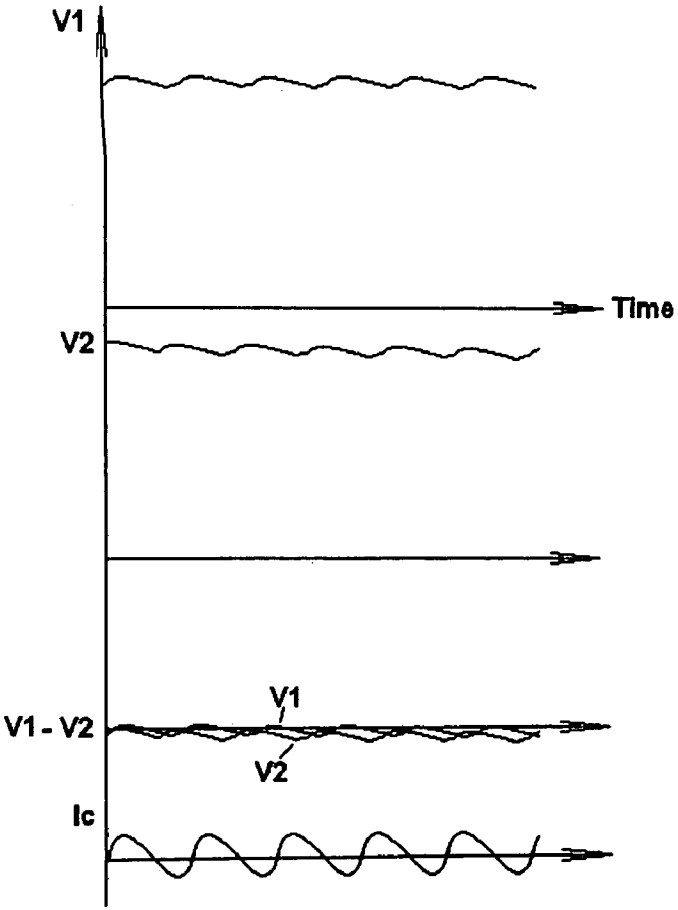
FIG. 2B is a timing diagram of voltages and currents between electrodes of neighboring EFA stages where a small voltage ripple exists between stages.
Figure 2A:
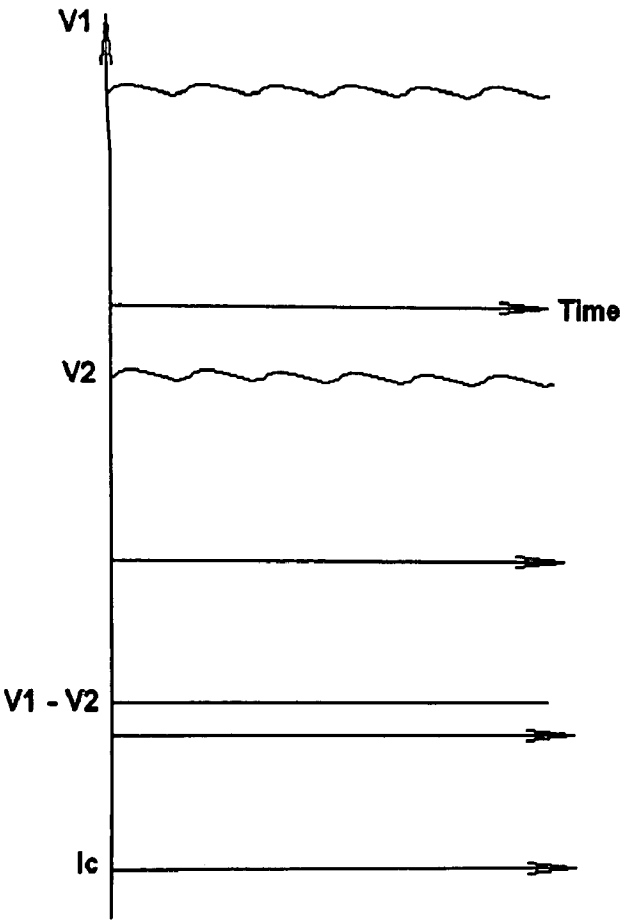
FIG. 2A is a timing diagram of voltages and currents between electrodes of neighboring EPA stages with no a.c. differential voltage component between the stages.

The reduction of parasitic capacitive current between electrodes of adjacent EPA stages can be seen with reference to the waveforms depicted in FIGS. 2A and 2B. As seen in the FIG. 2A, voltage V1 present on electrode 107 (FIG. 1B) and voltage V2 present on electrode 109 are synchronized and syn-phased, but not necessarily equal in d.c. amplitude. Because of complete synchronization, the difference V1−V2 between the voltages present on electrodes 107 and 109 is near constant representing only a d.c. offset value between the signals (i.e., no a.c. component). A current Ic flowing through the capacitive coupling between electrode 107 and electrode 109 is proportioned to the time rate of change (dV/dt) of the voltage across this capacitance:

$$I_c = C*[d(V1-V2)/dt].$$

It directly follows from this relationship that, if the voltage across any capacitance is held constant (i.e., has no a.c. component), no current flows the path. On the other hand, even small voltage changes may create large capacitive current flows if the voltage changes quickly (i.e., large d(V1−V2)/dt). In order to avoid excessive current flowing from the different electrodes of the neighboring EFA stages, voltages applied to the electrodes of these neighboring stages should be synchronized and syn-phased. For example, with reference to FIG. 2B, corona voltage V1 and V2 are slightly out of synchronization resulting in a small a.c. voltage component in the difference, d(V1−V2)/dt. This small a.c. voltage component results in a significant parasitic current Ic flowing between adjacent EFA stages. An embodiment of the present invention includes synchronization of power applied to all stages to avoid current flow between stages.

The closest spacing of electrodes of adjacent EFA stages may be approximated as follows. Note that a typical EFA operates efficiently over a rather narrow voltage range. The voltage $V_c$ applied between the corona discharge and collecting electrodes of the same stage should exceed the so called corona onset voltage $V_{onset}$ for proper operation. That is, when voltage $V_c$ is less than $V_{onset}$, no corona discharge occurs and no air movement is generated. At the same time $V_c$ should not exceed the dielectric breakdown voltage $V_b$ so as to avoid arcing. Depending on electrodes geometry and other conditions, $V_b$ may be more than twice as much as $V_{onset}$. For typical electrode configurations, the $V_b/V_{onset}$ ratio is about 1.4-1.8 such that any particular corona discharge electrode should not be situated at a distance from a neighboring collecting electrode where it may generate a "back corona." Therefore, the normalized distance aNn between closest electrodes of neighboring stages should be at least 1.2 times greater than the normalized distance "aNc" between the corona discharge and the collecting electrodes of the same stage and preferably not more than 2 times greater than distance "aNc." That is, electrodes of neighboring stages should be spaced so as to ensure that a voltage difference between the electrodes is less than the corona onset voltage between any electrodes of the neighboring stages.

If the above stated conditions are not satisfied, a necessary consequence is that neighboring stages must be further and more widely spaced from each other than otherwise. Such increased spacing between stages results in several conditions adversely affecting air movement. For example, increased spacing between neighboring stages leads to a longer duct and, consequently, to greater resistance to airflow. The overall size and weight of the EFA is also increased. With synchronized and syn-phased HVPSs, these negative aspects are avoided by allowing for reduced spacing between HFA stages without reducing efficiency or increasing spark generation.

Figure 3:
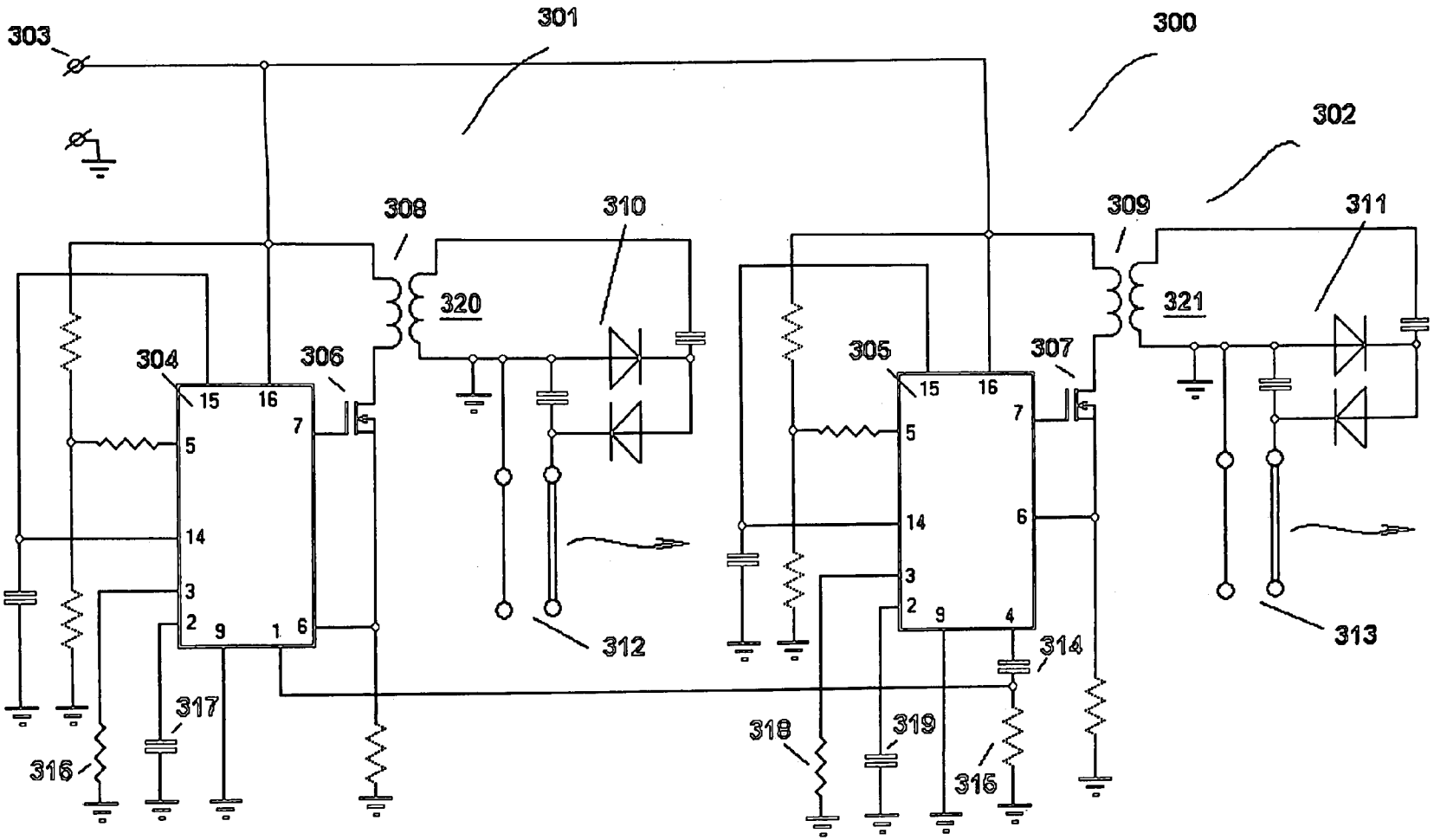
FIG. 3 is a schematic diagram of a power supply unit including a pair of high voltage power supply subassemblies having synchronized output voltages.

Referring to FIG. 3, a two stage EFA 300 includes a pair of converters in the form of HVPSs 301 and 302 associated with respective first and second stages 312 and 313. Both stages are substantially identical and are supplied with electrical power by identical HVPSs 301 and 302. HVPSs 301 and 302 include respective pulse width modulation (PWM) controllers 304 and 305, power transistors 306 and 307, high voltage inductors 308 and 309 (i.e., transformers or filtering chokes) and voltage doublers 320 and 321, each voltage doubler including rectifier circuits 310 and 311. HVPSs 301 and 302 provide power to respective EFA corona discharge electrodes of stages 312 and 313. As before, although EFA electrodes of stages 312 and 313 are diagrammatically depicted as single pairs of one corona discharge electrode and one accelerator (or attractor) electrode, each stage would typically include multiple pairs of electrodes configured in a two-dimensional array. PWM controllers 304, 305 generate (and provide at pin 7) high frequency pulses to the gates of respective power transistors 306 and 307. The frequency of these pulses is determined by respective RC timing circuits including resistor 316 and capacitor 317, and resistor 318 and the capacitor 319. Ordinarily, slight differences between values of these components between stages results in slightly different operating frequencies of the two HVPS stages which typically supply an output voltage within a range of 50 Hz to 1000 kHz. However, even a slight variation in frequency leads to non-synchronous operation of stages 312 and 313 of EFA 300. Thus, to ensure the synchronous and syn-phased (i.e., zero phase shift or difference) operation of power supplies 301 and 302, controller 305 is connected to receive a synchronization signal pulse from pin 1 of the PWM controller 304 via a synchronization input circuit including resistor 315 and capacitor 314. This arrangement synchronizes PWM controller 305 to PWM controller 304 so that both PWM controllers output voltage pulses that are both synchronous (same frequency) and syn-phased (same phase).

Figure 4B:
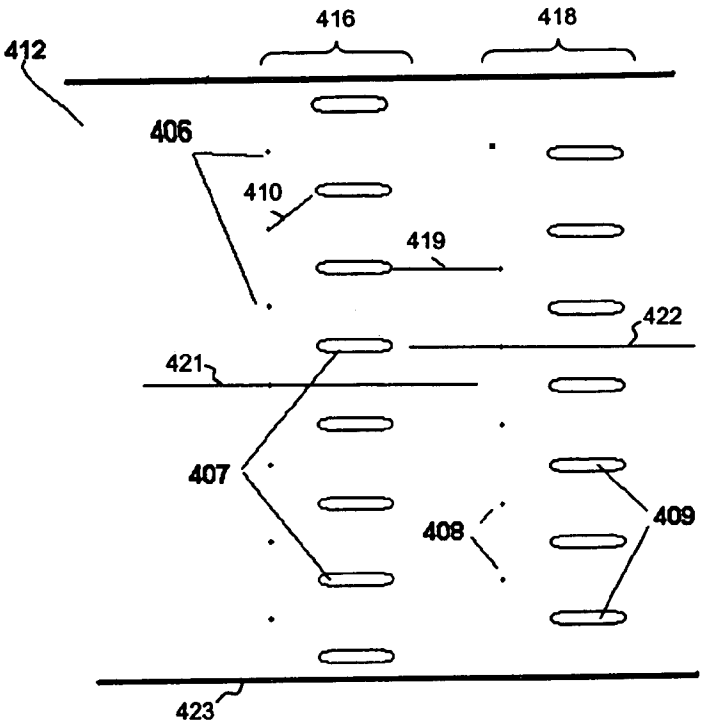
FIG. 4B is a schematic top view of a two stage EFA assembly implementing a second electrode placement geometry.
Figure 4A:
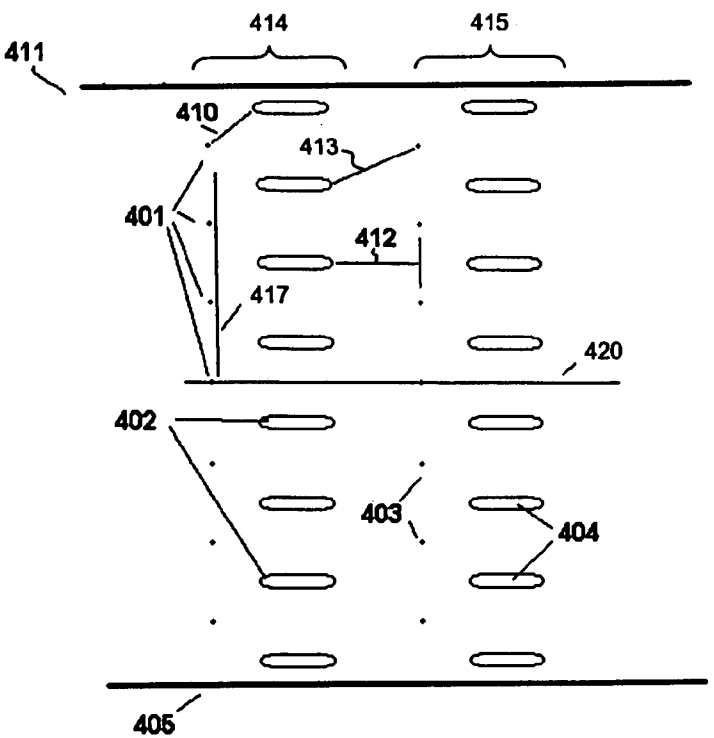
FIG. 4A is a schematic top view of a two stage EFA assembly implementing a first electrode placement geometry.

FIGS. 4A and 4B are cross-sectional views of two different arrangements of two-stage EFA devices. Although only two stages are illustrated, the principles and structure detailed is equally. With reference to FIG. 4A, first EFA device 411 consists of two serial or tandem stages 414 and 415. First stage 414 contains a plurality of parallel corona discharge electrodes 401 aligned in a first vertical column and collecting electrodes 402 aligned in a second columns parallel to the column of corona discharge electrodes 401. All the electrodes are shown in cross-section longitudinally extending in to and out from the page. Corona discharge electrodes 401 may be in the form of conductive wires as illustrated, although other configurations may be used. Collecting electrodes 402 are shown horizontally elongate as conductive bars. Again, this is for purposes of illustration; other geometries and configurations may be implemented consistent with various embodiments of the invention. Second stage 415 similarly contains a column of aligned corona discharge electrodes 403 (also shown as thin conductive wires extending perpendicular to the page) and collecting electrodes 404 (again as bars). All the electrodes are mounted within air duct 405. First and second stages 414 and 415 of EFA 411 are powered by respective separate HVPSs (not shown). The HVPSs are synchronized and syn-phased so the corona discharge electrodes 403 of second stage 415 may be placed at the closest possible normalized distance to collecting electrodes 402 of first stage 414 without adversely interacting and degrading EPA performance.

For the purposes of illustration, we assume that all voltages and components thereof (e.g., a.c. and d.c.) applied to the electrodes of neighboring stages 414 and 415 are equal. It is further assumed that high voltages are applied to the corona discharge electrodes 401 and 403 and that the collecting electrodes 402 and 404 are grounded, i.e., maintained at common ground potential relative to the high voltages applied to corona discharge electrodes 401 and 403. All electrodes are arranged in parallel vertical columns with corresponding electrodes of different stages horizontally aligned and vertically offset from the complementary electrode of its own stage in staggered columns. A normalized distance 410 between corona discharge electrodes 401 and the leading edges of the closest vertically adjacent collecting electrodes 402 is equal to aN1. Normalized distance aN2 (413) between corona electrodes 403 of the second stage and the trailing edges of collecting electrodes 402 of the first stage should be some distance aN2 greater that aN1, the actual distance depending of the specific voltage applied to the corona discharge electrodes. In any case, aN2 should be just greater than aN1, i.e., be within a range of 1 to 2 times distance aN1 and, more preferably, 1.1 to 1.65 times aN1 and even more preferably approximately 1.4 times aN1. In particular, as depicted in FIG. 4A, distance aN2 should be just greater than necessary to avoid a voltage between the corona onset voltage creating a current flow therebetween. Let us assume that this normalized "stant" distance aN2 is equal to 1.4×aN1. Then the horizontal distance 412 between neighboring stages is less than distance aN2 (413). As shown, intra-stage spacing is minimized when the same type of the electrodes of the neighboring stages are located in one plane 420 (as shown in FIG. 4A). Plane 414 may be defined as a plane orthogonal to the plane containing the edges of the corona discharge electrodes (plane 417 which is also substantially orthogonal to an airflow direction as shown in FIG. 4A). If the same type electrodes of neighboring states are located in different but parallel planes, such as planes 421 and 422 (as shown in FIG. 4B), the resultant minimal spacing distance between electrodes of adjacent EFA stages is equal to aN2 as shown by line 419. Note that the length of line 419 is the same as distance 413 (aN2) and is greater than distance 412 so that inter-stage spacing is increased.

In summary, embodiments of the invention incorporate architectures satisfying one or more of three conditions in various combinations:

1. Electrodes of the neighboring EFA stages are powered with substantially the same voltage waveform, i.e., the potentials on the neighboring electrodes should have substantially same alternating components. Those alternating components should be close or identical in both magnitude and phase.

2. Neighboring EFA stages should be closely spaced, spacing between neighboring stages limited and determined by that distance which is just sufficient to avoid or minimize any corona discharge between the electrodes of the neighboring stages.

3. Same type electrodes of neighboring stages should be located in the same plane that is orthogonal to the plane at which the electrodes (or electrodes leading edges) are located.

It should be noted and understood that all publications, patents and patent applications mentioned in this specification are indicative of the level of skill in the art to which the invention pertains. All publications, patents and patent applications are herein incorporated by reference to the same extent as if each individual publication, patent or patent application was specifically and individually indicated to be incorporated by reference in its entirety.

What is claimed is:

1. An electrostatic fluid accelerator comprising:

a first array of corona discharge electrodes disposed in a first plane;

a second array of corona discharge electrodes disposed in a second plane, said second plane being parallel to and spaced apart from said first plane; and a third array of accelerating electrodes disposed in a third plane, said third plane being parallel to said first and second planes and disposed therebetween, wherein each accelerating electrode of said third array is disposed in a staggered configuration with respect to said corona discharge electrodes of said first array, wherein a spacing between each corona discharge electrode of said second array and a nearest accelerator electrode of said third array is within the range of 1.2 to 2 times a spacing between each corona discharge electrode of said first array and a nearest accelerator electrode of said third array.

2. The electrostatic fluid accelerator of claim 1, wherein said spacing between each corona discharge electrode of said second array and a nearest accelerator electrode of said third array is within the range of 1.2 to 1.65 times said spacing between each corona discharge electrode of said first array and a nearest accelerator electrode of said third array.

3. The electrostatic fluid accelerator of claim 1, wherein said spacing between each corona discharge electrode of said second array and a nearest accelerator electrode of said third array is approximately 1.4 times said spacing between each corona discharge electrode of said first array and a nearest accelerator electrode of said third array.

4. An electrostatic fluid accelerator comprising:

a first array of corona discharge electrodes disposed in a first plane;

a second array of corona discharge electrodes disposed in a second plane, said second plane being parallel to and spaced apart from said first plane;

a third array of accelerating electrodes disposed in a third plane, said third plane being parallel to said first and second planes and disposed therebetween, wherein each accelerating electrode of said third array is disposed in a staggered configuration with respect to said corona discharge electrodes of said first array; and a forth array of accelerating electrodes disposed longitudinally in a forth plane, said forth plane being parallel to said first, second, and third planes and disposed on an opposite side of said second array than is said third plane, wherein each accelerating electrode of said forth array is disposed in a staggered orientation with respect to said corona discharge electrodes of said second array.

5. An electrostatic fluid accelerator comprising:

a first array of corona discharge electrodes disposed in a first plane;

a second array of corona discharge electrodes disposed in a second plane, said second plane being parallel to and spaced apart from said first plane;

a third array of accelerating electrodes disposed in a third plane, said third plane being parallel to said first and second planes and disposed therebetween, wherein each accelerating electrode of said third array is disposed in a staggered configuration with respect to said corona discharge electrodes of said first array; and a high voltage power supply circuit coupled to said first and third arrays, wherein a high voltage waveform provided to corona discharge electrodes of said first array is synchronized with a high voltage waveform provided to corona discharge electrodes of said second array.

6. The electrostatic fluid accelerator of claim 5, wherein said high voltage waveform provided to said first array is syn-phased with said high voltage waveform provided to said second array.

7. The electrostatic fluid accelerator of claim 5, wherein said high voltage power supply circuit comprises:

a first high voltage power supply coupled to said first array;

a second high voltage power supply coupled to said second array; and control circuitry coupled to said first and second high voltage power supplies and operable to control each said high voltage power supply to generate synchronized and syn-phased high voltage waveforms.

8. An electrostatic fluid accelerator system having a plurality of closely spaced electrostatic accelerator stages, said system comprising:

a first electrostatic accelerator stage having a first array of corona discharge electrodes disposed in a first plane and a first array of accelerating electrodes disposed in a second plane; and a second electrostatic accelerator stage having a second array of corona discharge electrodes disposed in a third plane and a second array of accelerating electrodes disposed in a forth plane, wherein each corona discharge electrode of said second array of corona discharge electrodes is disposed offset from each accelerating electrode of said first array of accelerating electrodes.

9. The system of claim 8, wherein each of said first, second, third, and forth planes are parallel.

10. The system of claim 8, further comprising:

a high voltage power supply circuit coupled to said first and second arrays of corona discharge electrodes, wherein a high voltage waveform provided to said first array of corona discharge electrodes is synchronized with a high voltage waveform provided to said second array of corona discharge electrodes.

11. The system of claim 10, wherein said high voltage waveform provided to said first array of corona discharge electrodes is syn-phased with said high voltage waveform provided to said second array of corona discharge electrodes.

12. The system of claim 10, wherein said high voltage power supply circuit comprises:

a first high voltage power supply coupled to said first array of corona discharge electrodes;

a second high voltage power supply coupled to said second array of corona discharge electrodes; and control circuitry coupled to said first and second high voltage power supplies and operable to control each said high voltage power supply to generate synchronized high voltage waveforms.

13. The system of claim 8, wherein each accelerating electrode of said first array of accelerating electrodes is disposed offset from each corona discharge electrode of said first array of corona discharge electrodes.

14. The system of claim 13, wherein each accelerating electrode of said second array of accelerating electrodes is disposed offset from each corona discharge electrode of said second array of corona discharge electrodes.

15. The system of claim 13, wherein corona discharge electrodes of said first array of corona discharge electrodes are disposed in alignment with corona discharge electrodes of said second array of corona discharge electrodes.

16. The system of claim 13, wherein a spacing between said corona discharge electrode of said first array of corona discharge electrodes and said accelerating electrodes of said first array of accelerating electrodes is a first distance, said first distance being greater than an intra-stage electrode spacing as measured along a line normal to each first and second planes.

17. The system of claim 16, wherein a spacing between each corona discharge electrode of said second array of corona discharge electrodes and said accelerating electrodes of said first array of accelerating electrodes is a second distance, said second distance being greater than an inter-stage electrode spacing as measured along a line normal to each said second and third planes, said second distance being greater than said first distance.

18. The system of claim 17, wherein said second distance is in the range of 1.2 to 2 times said first distance.

19. The system of claim 17, wherein said first distance is selected as a function of a corona onset voltage between said corona discharge electrodes of said first array of corona discharge electrodes and said accelerating electrodes of said first array of accelerating electrodes.

20. The system of claim 17, wherein said second distance is selected to prevent a back corona between said second electrostatic accelerator stage and said first electrostatic accelerator stage.

21. A method for providing an electrostatic fluid accelerator, said method comprising:

determining an intra-stage spacing to facilitate a corona onset voltage between corona discharge electrodes and accelerating electrodes of an electrostatic fluid accelerator while minimizing sparking between said corona discharge electrodes and said accelerating electrodes;

determining an inter-stage spacing to prevent a back corona forming between accelerating electrodes of a first electrostatic accelerator stage and corona discharge electrodes of a second electrostatic accelerator stage, said inter-stage spacing being within the range of 1.2 to 2.0 times said intra-stage spacing;

disposing said accelerating electrodes of said first electrostatic accelerator stage in a first plane; and disposing said corona discharge electrodes of said second electrostatic accelerator stage in a second plane, wherein said first and second planes are parallel, and wherein a spacing between said first and second planes is less than said inter-stage spacing.

22. The method of claim 21, wherein said disposing said corona discharge electrodes of said second electrostatic accelerator stage in said second plane comprises:

disposing said corona discharge electrodes parallel to and in an offset configuration with said accelerating electrodes.

23. The method of claim 21, further comprising:

disposing corona discharge electrodes of said first electrostatic accelerator stage is a third plane, wherein said first, second, and third planes are parallel, and wherein a spacing between said first and third planes is less than said intra-stage spacing.

24. The method of claim 23, wherein said disposing said corona discharge electrodes of said first electrostatic accelerator stage in said third plane comprises:

disposing said corona discharge electrodes of said first electrostatic accelerator stage parallel to and in-line with said corona discharge electrodes of said second electrostatic accelerator stage and parallel to and in an offset configuration with said accelerating electrodes of said first electrostatic accelerator stage.

25. The method of claim 21, further comprising:

providing said first electrostatic accelerator stage having a first array of corona discharge electrodes and a first array of accelerating electrodes comprising said accelerating electrodes of said first electrostatic accelerator stage, wherein said providing said first electrostatic accelerator stage includes spacing each corona discharge electrode of said first array of corona discharge electrodes apart from said accelerating electrodes of said first array of accelerating electrodes said intra-stage spacing;

providing a second electrostatic accelerator stage having a second array of accelerating electrodes and a second array of corona discharge electrodes comprising said corona discharge electrodes of said second electrostatic accelerator stage, wherein said providing said second electrostatic accelerator stage includes spacing each corona discharge electrode of said second array of corona discharge electrodes apart from said accelerating electrodes of said second array of accelerating electrodes said intra-stage spacing.

26. The method of claim 25, further comprising:

exciting said first electrostatic accelerator stage and said second electrostatic accelerator stage with a synchronized high voltage waveform.

27. The method of claim 26, further comprising:

syn-phasing said high voltage waveform such that a potential difference between said first array of corona discharge electrodes and said second array of corona discharge electrodes is maintained substantially constant.

* * * * *